US006138657A

United States Patent [19]

Richard

[11] Patent Number: 6,138,657

[45] Date of Patent: Oct. 31, 2000

[54] STONE CUTTER

[76] Inventor: Arcade C. Richard, 19 5th St., Leominster, Mass. 01453

[21] Appl. No.: 09/181,628

[22] Filed: Oct. 28, 1998

[51] Int. Cl.[7] ..... B28D 1/06

[52] U.S. Cl. ..... 125/16.03; 125/18; 125/23.01

[58] Field of Search ..... 125/23.01, 16.03, 125/16.04, 18; 83/515, 599, 601, 605

[56] References Cited

U.S. PATENT DOCUMENTS

| | | | |
|---|---|---|---|
| 1,906,599 | 5/1933 | Hoffert | 83/589 |
| 1,981,695 | 11/1934 | Gundlach | 83/515 |
| 2,077,477 | 4/1937 | Gundlach . | |
| 2,090,548 | 8/1937 | Nielsen | 164/44 |
| 2,703,613 | 3/1955 | Gundlach . | |
| 2,779,325 | 1/1957 | Beckham | 125/23 |
| 4,401,002 | 8/1983 | Worsham | 83/467 R |

*Primary Examiner*—Timothy V. Eley
*Assistant Examiner*—Dung Van Nguyen

[57] ABSTRACT

A stone cutter for cutting stock stone, in particular marble without causing undesirable and uneconomical breakage of the stone. The stone cutter comprises a movable cutter blade assembly, where the movable cutter blade assembly comprises a movable blade holder and an upper cutter blade; a stationary blade assembly, where the stationary blade assembly comprises a stationary blade holder and a stationary blade. The movable cutter blade assembly is mounted proximate an end of the stationary blade assembly. The stone cutter further comprises a support, where the support comprises at least a base and a table and provides a stable rest for the stationary blade assembly. A handle assembly is also provided to move the movable cutter blade assembly in a linear reciprocating motion toward and away from the stationary blade assembly. The distance between the stationary blade and movable blade are generally equidistant throughout movement of the movable cutter blade assembly. The handle assembly further comprises a generally U-shaped force distributor that contacts an upper surface of the movable cutter blade assembly so as to apply an evenly distributed force on the movable cutter blade assembly. An adjustment adjusts a distance between the stationary blade and the movable blade so stock piece of stone can be inserted between the movable blade and the stationary blade prior to movement of the handle assembly.

16 Claims, 4 Drawing Sheets

STONE CUTTER

BACKGROUND OF THE INVENTION

1. Field of Invention

The invention is related to stone cutters. In particular, the invention is directed to a cutter for stone, for example marble, that does not require an external power or water source, nor require a diamond blade saw. The stone cutter provides an even cut on the stock stone without incurring breakage of the stone.

2. Description of the Related Art

The cutting of stock stone, especially relatively hard and brittle stone that is normally used for floors, for example marble or tiles, is currently conducted in a very labor and energy intensive manner. For example, but in no way limiting, the cutting of marble normally requires a circular diamond blade saw that is wetted with a constant supply of water. If a wetted circular diamond blade saw is not utilized, it is very likely that the marble will break, split or fracture. Thus, the stock stone will not be usable. Further, if a wetted circular diamond blade saw is not used, the cut will be, at best, rough, uneven and not suitable for an open surface. Accordingly, the cut stone will be an inferior quality and usually unusable.

While a wetted circular diamond blade saw provides an acceptable cut, the wetted circular diamond blade saw requires a power source as well as a water source. Thus, during a construction process or project, the cutting and fitting of stock stone is often the last event in construction, after the connection of water and power. This positioning in the construction process is inconvenient and difficult, since other finishing work is usually needed after the stone has been placed. Thus, the need for a power and water supply for cutting stone, in particular marble, is inconvenient.

Several cutters for stone are known in the art. However, due to the relative hardness of marble, they have not been known to be used to cut marble. For example, U.S. Pat. Nos. 1,981,695 and 2,077,474 to Gundlach and U.S. Pat. No. 3,886,927 describe cutters for stone, and in particular asbestos. These cutters do not provide means to assure an even cut of the marble. Further, these cutters do not provide a support for main piece of supply stone and also for the cut piece of stone.

Known cutters provide a scissor-like unevenly applied force on the stock stone. This scissor-like unevenly applied force does not provide an exacting evenly applied cutting force. Accordingly, the scissor-like unevenly applied force on the stock stone often results in breakage of the stock stone, where the breakage not along the intended cutting line. Therefore, the scissor-like unevenly applied force on the stock stone results in an un-usable piece of stone, thus creating a substantial waste of resources. This, of course, is undesirable and should be avoided.

SUMMARY OF THE INVENTION

Accordingly, it is desirable to provide a cutter for stone, in particular marble, that overcomes the above, and other, disadvantages in the prior art.

A stone cutter for cutting stock stone, in particular marble without causing undesirable and uneconomical breakage of the stone. The stone cutter comprises a movable cutter blade assembly, where the movable cutter blade assembly comprises a movable blade holder and an upper cutter blade; a stationary blade assembly, where the stationary blade assembly comprises a stationary blade holder and a stationary blade. The movable cutter blade assembly is mounted proximate an end of the stationary blade assembly. The stone cutter further comprises a support, where the support comprises at least a base and a table and provides a stable rest for the stationary blade assembly. A handle assembly is also provided to move the movable cutter blade assembly in a linear reciprocating motion toward and away from the stationary blade assembly. The distance between the stationary blade and movable blade are generally equidistant throughout movement of the movable cutter blade assembly. The handle assembly further comprises a generally U-shaped force distributor that contacts an upper surface of the movable cutter blade assembly so as to apply an evenly distributed force on the movable cutter blade assembly. An adjustment adjusts a distance between the stationary blade and the movable blade so stock piece of stone can be inserted between the movable blade and the stationary blade prior to movement of the handle assembly.

These and other objects, advantages and salient features of the invention will become apparent from the following detailed description, which, when taken in conjunction with the annexed drawings, disclose preferred embodiments of the invention.

BRIEF DESCRIPTION OF THE DRAWINGS

While the novel features of this invention are set forth in the following description, the invention will now be described from the following detailed description of the invention taken in conjunction with the drawings, in which.

DETAILED DESCRIPTION OF THE INVENTION

Marble is a relatively hard and relatively brittle type of stone. As is known in the art, marble breaks easily if dropped or mishandled, especially in light of the many grains, boundaries and inclusions in the marble. While the grains, boundaries and inclusions in the marble are some of the desirable features of the marble, the grains, boundaries and inclusions in the marble are often the cause of improper and undesirable breakages in marble. For example, if an inadvertent force or misapplied cut is made to marble, the marble may break or be cracked in a location not intended, both of which are undesirable.

As discussed above, marble is normally cut with a rotating diamond blade saw, which is constantly wetted to maintain a fine cut and to avoid braking the marble. The cutting with a wetted rotating diamond saw requires a power supply and water supply, both of which are normally only available just prior to finishing a new construction process or project. The cutting with a wetted rotating diamond saw is extremely time consuming and energy intensive. For example, it may take upwards of 3 minutes to cut across a 12 inch square of ½ thick inch marble piece of stock stone. The time to cut with a cutting with a wetted rotating diamond saw is approximately doubled if the thickness of the marble is about 1 inch. Therefore, to cut an entire floor of marble, an entire day is needed for merely the cutting. Still further time is required to lay the marble.

The cutting and laying of marble with a cutting with a wetted rotating diamond saw requires a significantly long time in a construction process. Since the marble floor is normally one of the last things to go into a construction, delays finishing of the construction are often incurred. Therefore, an undesirable and inconvenient delay occurs just prior to completion of the construction.

The invention provides a stone cutter, in particular a cutter for marble, that does not require either a water supply or a power source. Thus, the cutting of stock stone can occur at any point in a construction process, and does not have to cause delays in finishing a project. The stone cutter, as embodied in the invention, provides a quick and accurate cutting of the stone so as to lessen the time needed for cutting and laying a floor.

The stone cutter 1, as embodied in FIGS. 1–5, will now be described. The stone cutter 1 comprises a stone cutting and support assembly 2 and a handle actuator assembly 3. The handle and actuator assembly 3 are pivoted on the stone cutting and support assembly 2 for cutting the stock stone, as described hereinafter.

Figure 3:
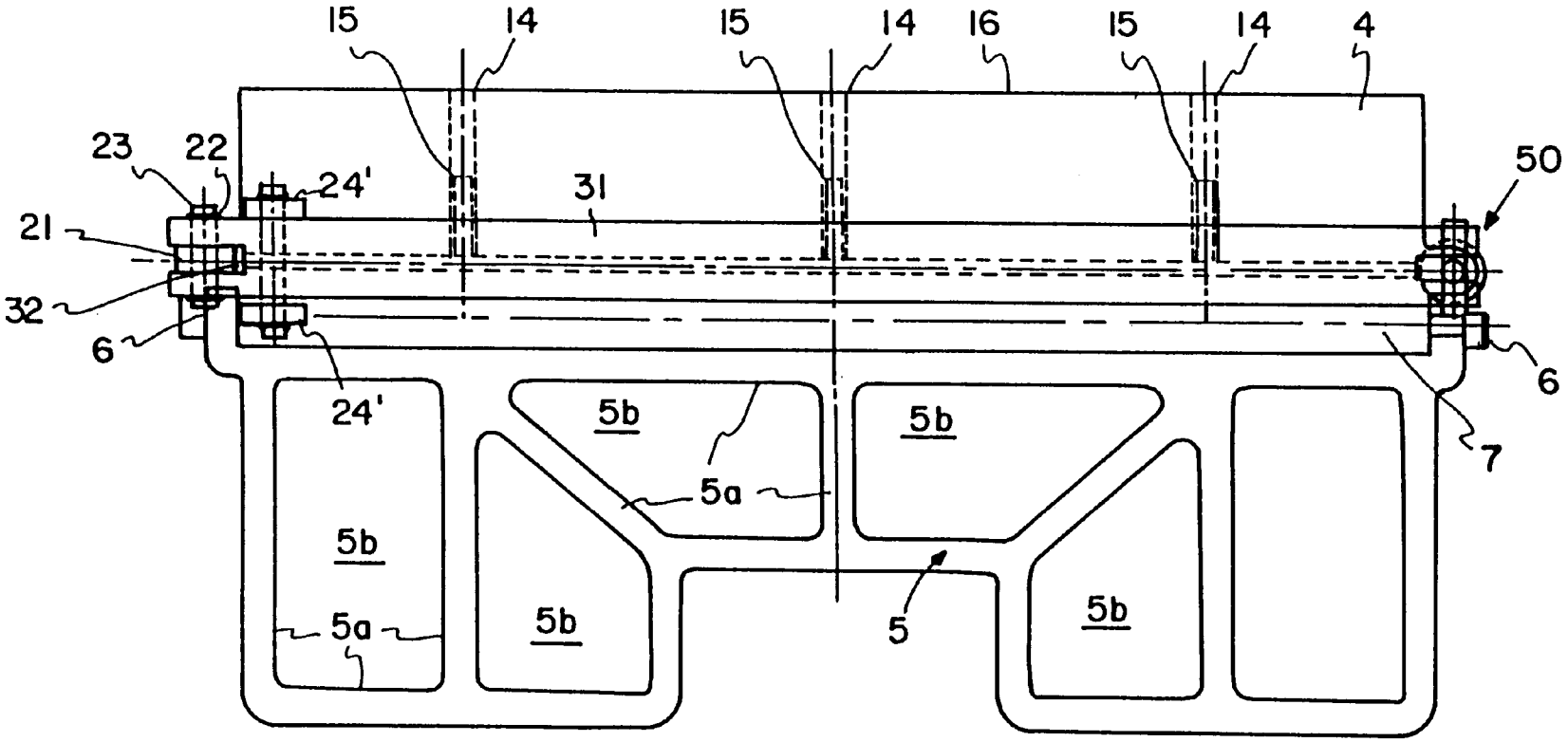
FIG. 3 is a bottom perspective illustration of a stone cutter in accordance with the invention.

The stone cutting and support assembly 2 comprises a support base 4 and table 5. The base 4 normally supports the supply stock of stone (not illustrated) and the table 5 normally supports the piece of stone that is cut from the supply stock of stone, during use of the stone cutter 1. However, the base 4 can support and the table 5 can support the supply stock of stone (not illustrated) during use. The table 5 is pivotally connected to the base 4 at pivots 6. The pivots 6 comprise any appropriate pivot structure, as known in the art, and permit the table 5 to pivot on axis 7, from a cutting position, as illustrated in FIG. 3, to a stored position (not illustrated), where the table is pivoted to a generally orthogonal relationship with the base 4. In the stored position, the table 5 serves as a handle to facilitate portage of the stone cutter 1.

Figure 4:
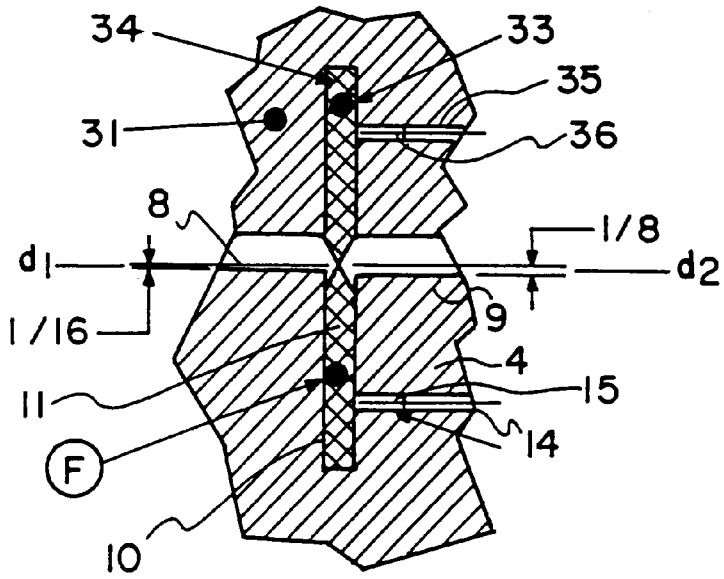
FIG. 4 is a perspective illustration of a stone cutter blade assembly in accordance with the invention.

The base 4, as embodied in the invention and illustrated in FIG. 4 in particular, defines a stepped surface. The stepped surface comprises a first base surface 8 and a second base surface 9. The plane of the first base 8 surface is slightly above the plane of the second base surface 9. This orientation defines the stepped surface.

The base 4 further comprises a blade recess 10, which receives a base cutting blade 11. The base cutting blade 11 extends above the first base surface 8 of the stepped surface for a first predetermined distance d1 and extends above the second base surface 9 for a second predetermined distance d2, where d2>d1. This difference permits a stone that is cut to drop, under the effects of gravity, a minimal distance to clear the base cutting blade 11 and the moved cutting blade 33, without breaking the stock stone. Further, this difference permits a small amount of torque on the stone but not enough to impair the cutting operation or break the stock stone.

Figure 5:
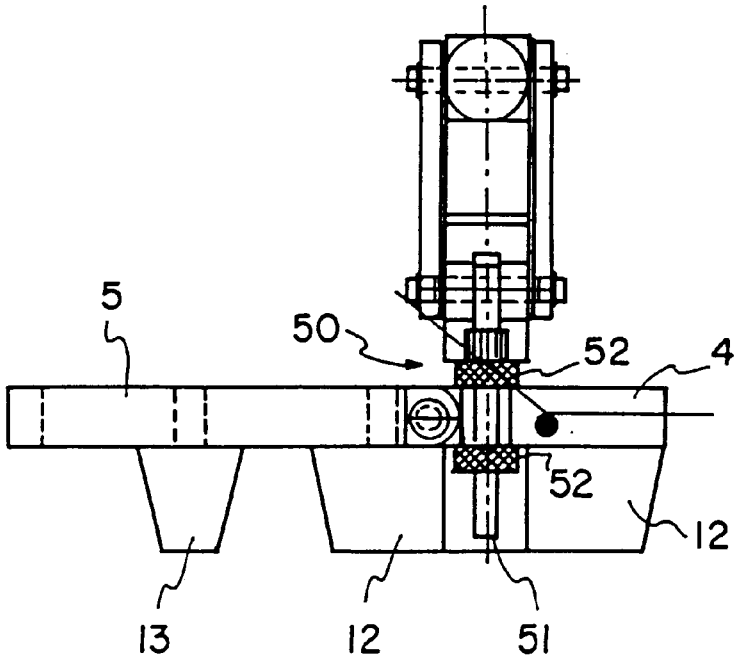
FIG. 5 is a perspective illustration of a stone cutter adjustment structure in accordance with the invention.

The base 4 is supported on a supporting surface, such as but not limited to a work station, the ground, vehicle and the like, on at least one leg 12, and as illustrated in FIG. 5 as plurality of legs 12. Preferably, the base 4 comprises a plurality of legs 12 so as to provide a stable and even support for the stone cutter 1. The table 5 also comprises at least one table leg 13, which when the table is in the pivoted down position, provides a stable and even support for the stone cutter 1.

The base 4 further comprises at least one locking screw bore 14. The locking screw bore 14 extends from an end 16 of the base 4 to the blade recess 10. A locking screw 15 is inserted into each locking screw bore 14. The locking screw 15 is inserted a sufficient distance into the locking screw bore 14 to abut and stably hold the base cutting blade 11 in the blade recess 10. Each locking screw 15, when in its loosened position, permit removal of the base cutting blade 11 from the blade recess 10 for sharpening, replacement and inspection.

The base 4 is formed from any suitable hard material that supports the stone to be cut, and provides a stable and sufficiently rigid support for the cutting blade 11. For example but in no way limiting the invention, the base 4 comprises at least one of metal, wood, plastics, hardened rubber, and other such material.

The table 5 is also formed from any suitable hard material that supports the stone to be cut. For example but in no way limiting the invention, the table 5 comprises at least one of metal, wood, plastics, hardened rubber, and other such material. As illustrated, that table 5 comprises several leg-like pieces 5*a* that are interconnected to form the table. Spaces 5*b* are formed in the table 5 by the leg-like pieces 5*a*. The combination of spaces 5*b* and leg-like pieces 5*a* are interconnected, and provide a rigid, strong and stable table 5. The combination of spaces 5*b* and leg-like pieces 5*a* also make the table 5 and the stone cutter 1 less heavy, compared to a solid table. This is desirable since the stone cutter 1 will be transported from place to place, possibly by hand. It therefore, is preferable that the stone cutter 1 be as light weight as possible in order to facilitate handling of the stone cutter 1.

The stone cutter 1 further comprises a pivot mechanism 20 to pivotally connect a top, upper or movable cutter assembly 30 (to be described hereinafter) to the base 4. The pivot mechanism 20 comprises a plurality of pivot linkages. The illustrated embodiment illustrates two linkages 21 and 24, however more than two linkages are within the scope of the invention. Linkage 21 is connected to the base 4 at a pivot 22, using for example a pivot pin 23. Linkage 24 comprises two parallel linkages 24', 24' that are connected to the outside of the top cutter assembly 30, as illustrated in FIG. 3. The top cutter assembly 30 comprises a blade holder 31 with a recess 32 (FIG. 3) to receive in a nesting fashion the linkage 21. In this manner, the linkage 21 is snugly received in the stone cutter 1 when not in use, to form a relatively compact structure of the stone cutter 1.

The linkages 21 and 24 are both connected at their ends opposite the base 4 and upper cutter assembly 30, respectively to a handle actuator assembly 40. The linkage 21 is connected to handle actuator assembly 40 at a pivot 41, using for example a pivot pin 42. The linkage 24, which comprises the two parallel linkages 24' are connected to the outside of handle actuator assembly 40, as illustrated in FIG. 3. The handle actuator assembly 40 also comprises a recess 37 to receive in a nesting fashion the linkage 21, in manner similar to the nesting of linkage 21 in the recess 32. In this manner, the linkage 21 is snugly received in the stone cutter 1 when not in use, to form a relatively compact structure.

The blade holder 31 of the upper cutter assembly 30 comprises a rigid stable material that holds an upper cutter blade 33 in an upper cutter blade groove or recess 34. The blade holder 31 further comprises at least one locking screw bore 35. The looking screw bore 35 extends to the upper cutter blade groove or recess 34. Locking screw 36 is inserted into each upper cutter blade groove or recess 34 and is inserted to a sufficient distance to abut and stably hold the base cutting blade 33 in the upper cutter blade groove or recess 34. The locking screws 36, when in their loosened position, permit removal of the base cutting blade 33 from the upper cutter blade groove or recess 34 for sharpening, replacement and inspection, in a manner similar to the screws in the base 4.

An adjustment device 50 is positioned at an end of the blade holder 31 of the upper cutter assembly 30, opposite the pivot mechanism 20. The adjustment device 50 comprises any known adjustment mechanism, which will permit movement of the blade holder 31 of the upper cutter assembly 30 away from the base 4. For example, as embodied in FIGS. 1, 2 and 5, the adjustment device 50 comprises a height adjustment screw 51 and at least one and preferably a plurality, of adjustment lock screws 52.

Figure 1:
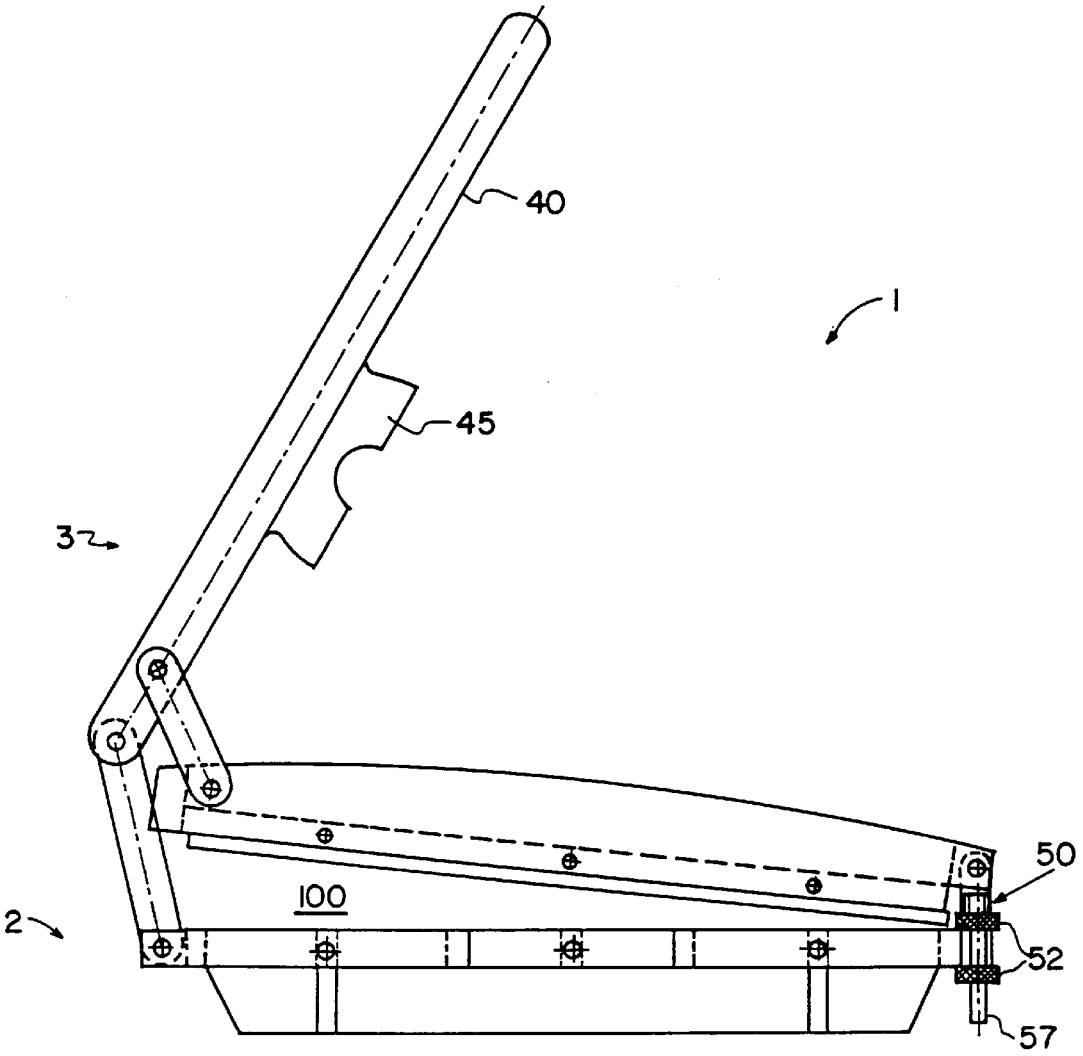
FIG. 1 is a side perspective illustration of a stone cutter in an open position in accordance with the invention.

The vertical position (as illustrated in FIG. 1) of the blade holder 31 of the upper cutter assembly 30 from the base 4 can be adjusted in an up and down fashion by rotating the height adjustment screw 51. Then, when the desired height for the intended stock stone is reached, locking in this position using the adjustment lock screws 52 is possible. In this manner, the blade holder 31 of the upper cutter assembly 30 is moved basically in a reciprocal manner with equidistant, as a unit and evenly. In other words, the end of the blade holder 31 of the upper cutter assembly 30 proximate the pivot mechanism 20 is moved substantially the same distances the end of the blade holder 31 of the upper cutter assembly 30 proximate the adjustment device 50.

The handle actuator assembly 40 comprises pivot hole 41 and pivot pin 42, as discussed previously. The handle actuator assembly 40 also comprises a pivot hole 43 and pivot pin 44 for linkage 24. Each pivot pin 42 and 44 may be provided on the handle actuator assembly 40, may be provided on the respective linkage 21 and 24, or may be a separate component to the handle actuator assembly 40 and the linkages 21 and 24.

The handle actuator assembly 40 further comprises a pressure distributor 45 that distributes an essentially even force from the handle actuator assembly 40 to the upper cutter assembly when in operation, to be described hereinafter. The force distributor 45 is constructed in a generally U-shaped manner with depending legs 45" ending at ends 45'. The legs 45" of the force distributor 45, when moved against the upper cutter assembly 30, applies an evenly distributed force to cut the stock stone (as described hereinafter). The force distributor 45 is from any appropriate material, such as but not limited to hard rubber, plastic, metals, wood, natural and synthetic materials. The material of the force distributor 45 is provides so that will evenly transfer forces from the handle actuator assembly 40 to the upper cutter assembly 30, so that the stone cutter 1 will effectively cut the stone.

The operation of the stone cutter 1 will now be described with reference to the figures. The table 5 of the stone cutter 1 is lowered into the operating position, as illustrated in FIG. 3. Preferably, the stone cutter 1 is positioned on a flat, hard and relatively stable platform, so that the legs 12 and 13 are even and stable. It is further desirable to position the stone cutter 1 on as flat a platform as possible to obtain a desirable operation of the stone cutter 1.

The spacing between the blade holder 31 of the upper cutter assembly 30 and the base 4, and subsequently the blade 11, the first surface 8 and the second surface 9, is determined initially by a rough operator estimated observation. The operator of the stone cutter then can make any further rough adjustments in height necessary by the operating the adjustment device 50, to either raise or lower the upper cutter assembly 30. The stock stone is then positioned on one of the table 5 and the base 4.

A final adjustment of height is made by fine tuning the height using the adjustment device 50 with the stock stone as a guide for adjusting the adjustment device 50. Preferably, after the final adjustment of the adjustment device 50, there is a minimal relatively small amount of difference in height between the stock stone and the blade 33 of the upper cutter assembly 30 and the base 4 and blade 11. With the relatively small amount of difference in height, any amount of lost motion before the upper blade 33 strikes the stone is minimized. This feature reduces the amount of work necessary to cut stone.

The handle actuator assembly 40 is next moved into its upper position, otherwise known as its raised position, and the stock stone is moved into the desired cutting position under the blade, as predetermined by the user prior to inserting the stone into the stone cutter. During movement of the handle actuator assembly 40 into its upper or raised position, the handle 49 is pivoted about the pivot mechanism 20. The force distributor 45 is moved from the upper surface 30' of the upper cutter assembly 30. The ends 45' of the force distributor 45 move in an essentially straight line in a substantially equal distance above the surface 30' of the upper cutter assembly 30.

The movement of the handle actuator assembly 40 into its upper or raised position causes the pivot mechanism 20 to first move the linkages 24, in a counter clockwise motion. The counter clockwise motion of the linkages 24 raises the blade holder 31 of the upper cutter assembly 30 above the base 4. After a predetermined rotation of the handle 49, the linkage 21 is then also caused to be rotated. The linkage 21 is rotated in a counter clockwise direction. The counter clockwise rotation of the linkage 21 further raises the blade holder 31 of the upper cutter assembly 30 above the base 4. This position is illustrated in FIG. 1.

Next the stock stone is moved along the base 4 and the table 5. The stock stone is inserted under the blade holder 31 of the upper cutter assembly 30, so as to be positioned between the blade 33 and the blade 11, up to the predetermined point, as determined and set by the operator. The stock stone, for example marble, is positioned so that the stock stone will be cut on a predetermined operator defined desired line.

The handle actuator assembly 40 is then pivoted clockwise about the pivot mechanism 20. This operation initiates the closing of the upper blade assembly 30 into cutting relation with the stock stone. First the ends 45' of the force distributor 45 will contact the surface 30' of the upper cutter assembly 30 and apply an essentially equal pressure on the upper cutter assembly 30.

Figure 2:
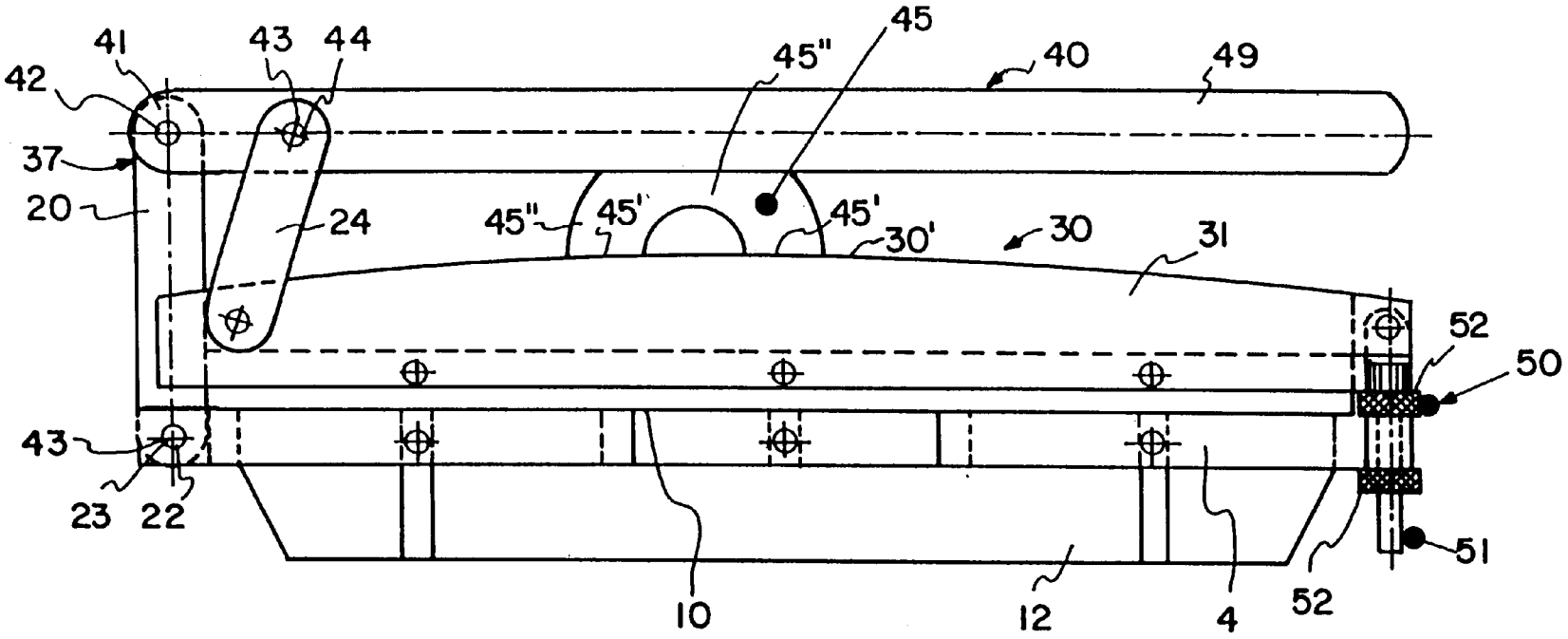
FIG. 2 is a side perspective illustration of a stone cutter in accordance with the invention in a closed position.

During further rotation of the handle 49 about the pivot assembly 20, the cutting blade assembly 30 is caused to move, through the interaction of the linkages 21 and 24 in a relatively linear fashion vertically (as illustrated in FIG. 2, however the term vertical is merely used as a reference direction since other possible orientations of the stone cutter 1 are within the scope of the application).

The blade 33 of the cutting assembly 30 contacts the stock stone over substantially the entire length of the blade 33. Also, the movement of the handle 49 will move the cutting assembly 30 downward so as to provide a pushing force on the stock stone over the area of the stock stone in direct general proximity to the cutting assembly 30 and the lower cutting blade 10. Thus, this movement essentially "pinched" the stone between the respective upper and lower cutting blades 10 and 33.

Accordingly, the stock stone is subjected to a pinching essentially equally applied even cutting force, due in part to the evenly applied and distributed force from the movement of the handle 49 and the force distributor 45. The movable blade 33 is adjusted so it moves essentially linearly being equidistant over its entire length with respect to the stationary blade 11 during a cutting motion. The illustration in FIG. 1 shows an angled opening 100 prior to insertion of the stock stone into the stone cutter 1 at the opening 100. When the stock stone is in the opening 100 the upper cutter assembly 30 is adjusted so there is a generally parallel relationship between the movable blade 33 and the stationary blade 11.

Thus, With the essentially equally applied even cutting force, the stone will be cut be the force of the upper and lower blades 33 and 10 respectively. With the tables 4 and 5 being relatively close supporting the stock stone, the stock stone is supported so there is little, if any, torque or twisting cantilever type movement of the stock stone when cut. Thus, the likelihood of breakage of the stock stone during and after cutting is minimized, and in practicality eliminated.

As illustrated in FIG. 1, a jagged "saw-tooth" cutting edge 33' and 11' can be provided on the movable cutting blade 33 and the stationary blade 11. However, the scope of the invention comprises both, at least one of, or neither of the movable cutting blade 33 and the stationary blade 11 comprising a jagged saw-tooth cutting edge.

While the embodiments described herein are preferred, it will be appreciated from the specification that various combinations of elements, variations or improvements therein may be made by those skilled in the art that are within the scope of the invention.

What is claimed is:

1. A stone cutter for cutting stock stone, the stone cutter comprising:

a movable cutter blade assembly, the movable cutter blade assembly comprising a movable blade holder and an upper cutter blade;

a stationary blade assembly, the stationary blade assembly comprising a stationary blade holder and a stationary blade, the movable cutter blade assembly being mounted proximate an end of the stationary blade assembly;

a support, the support comprising at least a base and a table and providing a stable rest for the stationary blade assembly, wherein the table is pivotally mounted to the base, so the table is capable of pivoting to a generally orthogonal position with respect to the base;

a handle assembly that moves the movable cutter blade assembly in a linear reciprocating motion toward and away from the stationary blade assembly, wherein the distance between the stationary blade and movable blade are generally equidistant throughout movement of the movable cutter blade assembly; the handle assembly further comprising a generally U-shaped force distributor that contacts an upper surface of the movable cutter blade assembly so as to apply an evenly distributed force on the movable cutter blade assembly; and an adjustment assembly, the adjustment assembly for adjusting a distance between the stationary blade and the movable blade so a stock piece of stone can be inserted between the movable blade and the stationary blade prior to movement of the handle assembly.

2. The cutter according to claim 1, the table further comprising a plurality of interconnected leg prices, the plurality of interconnected leg pieces defining a plurality of spaces in the table.

3. The cutter according to claim 2, wherein the plurality of spaces comprises a handle for transporting the stone cutter.

4. The cutter according to claim 1, further comprising a pivot assembly mounting the movable blade assembly proximately at an end of the stationary blade assembly.

5. The cutter according to claim 4, the pivot assembly comprising at least one first pivot linkage connected to the movable blade and the handle assembly and at least one second pivot linkage connected to the support and the handle assembly.

6. The cutter according to claim 5, where the at least one second pivot linkage is connected to the base.

7. The cutter according to claim 1, the movable cutter blade assembly comprising a movable blade holder and a movable blade.

8. The cutter according to claim 7, the movable blade holder further comprising a movable blade holder groove, the movable blade being releasably held in the movable blade holder groove by at least one movable blade locking screw.

9. The cutter assembly according to claim 8, wherein the movable blade holder groove extends substantially over a length of the movable blade holder.

10. The cutter according to claim 1, the stationary blade assembly comprising a stationary blade holder and a stationary blade.

11. The cutter according to claim 10, the stationary blade holder further comprising a stationary blade holder groove, the stationary blade being releasably held in the movable blade holder groove by at least one stationary blade locking screw.

12. The cutter according to claim 1, the base comprising a first surface and a second surface, the second surface being positioned, with respect to the stationary blade assembly at a height less than the first surface.

13. The cutter according to claim 1, where at least one of the movable cutter blade assembly cutting blade and the stationary blade assembly cutting blade comprise a saw tooth cutting edge.

14. The cutter according to claim 1, the adjustment device further comprising at least one adjustment screw, the at least one adjustment screw being movable to adjust the movable cutter blade assembly with respect to the stationary blade assembly.

15. The cutter according to claim 1, the a generally U-shaped force distributor that contacts an upper surface of the movable cutter blade assembly is formed from a material selected from the group consisting of:

hard rubber, plastic, metals, wood, natural and synthetic materials.

16. A stone cutter for cutting stock stone, the stone cutter comprising:

a movable cutter blade assembly, the movable cutter blade assembly comprising a movable blade holder and an upper cutter blade;

a stationary blade assembly, the stationary blade assembly comprising a stationary blade holder and a stationary blade, the movable cutter blade assembly being mounted proximate an end of the stationary blade assembly;

a support, the support comprising at least a base and a table and providing a stable rest for the stationary blade assembly, wherein the table is pivotally mounted to the base, so the table is capable of pivoting to a generally orthogonal position with respect to the base;

a handle assembly that moves the movable cutter blade assembly in a linear reciprocating motion toward and away from the stationary blade assembly, wherein the distance between the stationary blade and movable blade are generally equidistant throughout movement of the movable cutter blade assembly; the handle assembly further comprising a generally U-shaped force distributor that contacts an upper surface of the movable cutter blade assembly so as to apply an evenly distributed force on the movable cutter blade assembly; and an adjustment assembly, the adjustment assembly for adjusting a distance between the stationary blade and the movable blade so a stock piece of stone can be inserted between the movable blade and the stationary blade prior to movement of the handle assembly, wherein the stock stone is marble.

* * * * *